US006546864B2

(12) United States Patent
Kusaka

(10) Patent No.: US 6,546,864 B2
(45) Date of Patent: Apr. 15, 2003

(54) INKING DEVICE OF ROTARY PRESS

(75) Inventor: Akehiro Kusaka, Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/863,517

(22) Filed: May 24, 2001

(65) Prior Publication Data

US 2001/0045168 A1 Nov. 29, 2001

(30) Foreign Application Priority Data

May 24, 2000 (JP) ..... 2000-152437

(51) Int. Cl.[7] ..... B41F 31/06
(52) U.S. Cl. ..... 101/350.1; 101/347; 101/364
(58) Field of Search ..... 101/347, 349.1, 101/350.1, 350.2, 351.4, 351.5, 352.02, 352.01, 352.03, 352.04, 364, 363

(56) References Cited

U.S. PATENT DOCUMENTS

| | | | | |
|---|---|---|---|---|
| 2,887,049 A | | 5/1959 | Mueller | |
| 3,589,288 A | | 6/1971 | Lake | |
| 4,130,057 A | * | 12/1978 | List et al. | 101/148 |
| 4,373,442 A | * | 2/1983 | Dahlgren et al. | 101/148 |
| 4,419,932 A | * | 12/1983 | Cappel | 101/210 |
| 4,481,883 A | * | 11/1984 | Savart et al. | 101/363 |
| 4,517,221 A | * | 5/1985 | Holl | 101/184 |
| 4,700,631 A | * | 10/1987 | Jurinak | 101/352.11 |
| 4,843,966 A | * | 7/1989 | Jeschke et al. | 101/207 |
| 5,111,747 A | * | 5/1992 | Kobler et al. | 101/157 |
| 5,161,465 A | * | 11/1992 | Lewis et al. | 101/467 |
| 5,487,336 A | * | 1/1996 | Simeth | 101/216 |
| 5,533,450 A | | 7/1996 | Hachiya et al. | |
| 5,848,570 A | * | 12/1998 | Koppelkamm et al. | 101/351.3 |
| 6,076,463 A | * | 6/2000 | Vrotacoe et al. | 101/350.1 |

FOREIGN PATENT DOCUMENTS

| | | |
|---|---|---|
| DE | 1931696 A | 10/1970 |
| JP | 2612594 B2 | 2/1997 |

* cited by examiner

*Primary Examiner*—John S. Hilten
*Assistant Examiner*—Dave A. Ghatt
(74) *Attorney, Agent, or Firm*—Birch, Stewart, Kolasch & Birch, LLP

(57) ABSTRACT

An inking device of a rotary press comprises an ink fountain roller rotatably supported on left and right frames, and an ink fountain device movable toward and away from the ink fountain roller. The ink fountain device is switchable among a fixed position close to the ink fountain roller, a throw-off position separated from the ink fountain roller, and an intermediate position provided between the fixed position and the throw-off position, and switching means is provided for switching the ink fountain device by a pivoting operation of a locking handle so that the ink fountain device is located at any of the three positions. The inking device makes it easy to secure a vertical space for operating an ink fountain, and can fix the ink fountain device with a constant clamping force without a tool.

13 Claims, 5 Drawing Sheets

INKING DEVICE OF ROTARY PRESS

The entire disclosure of Japanese Patent Application No. 2000-152437 filed on May 24, 2000 including specification, claims, drawings, and abstract is incorporated herein by reference in its entirety.

BACKGROUND OF THE INVENTION

1. Field of the Invention

This invention relates to an inking device of a rotary press.

2. Description of the Related Art

Among rotary presses, there has been a four-color double-sided simultaneous offset printing press as shown, for example, in FIG. 5 (see Japanese Patent No. 2612594). According to this type of printing press, a blanketed impression cylinder 101 with a paper gripping device and a blanket cylinder 102 without a paper gripping device are supported in a nearly horizontal position in a printing unit 100, with the circumferential surfaces of the blanketed impression cylinder 101 and the blanket cylinder 102 being in contact with each other. Four plate cylinders 103 are arranged on the circumferential surface of the blanketed impression cylinder 101, and four plate cylinders 104 are similarly arranged on the circumferential surface of the blanket cylinder 102. Inking units 105, 106 are provided to be movable toward and away from the plate cylinders 103, 104, and can supply ink and water while contacting the plate cylinders 103, 104.

On the other hand, a delivery cylinder 108 of a delivery unit 107 is disposed below the blanketed impression cylinder 101, and a chain 109 is disposed leftward of the delivery cylinder 108 without crossing a space below a position of contact between the circumferential surfaces of the blanketed impression cylinder 101 and the blanket cylinder 102. Transfer cylinders 111 to 114 with paper gripping devices are provided for transferring a sheet from a register 110 to the blanketed impression cylinder 101. Similarly, a transfer cylinder 115 with a paper gripping device is provided for transferring a sheet from the blanketed impression cylinder 101 to the delivery cylinder 108. Numeral 116 denotes a feeder.

A sheet fed from the feeder 116 and positioned by the register 110 is transported along a route indicated by arrows in the drawing, namely, along the circumferential surfaces of the transfer cylinders 111 to 114, blanketed impression cylinder 101, transfer cylinder 115, and delivery cylinder 108 in this order. When the sheet passes through the point of contact between the blanketed impression cylinder 101 and the blanket cylinder 102 downwardly from above, both sides of the sheet are printed simultaneously.

In the inking units 105, 106, inking devices 105*a* to 105*d*, 106*a* to 106*d* for four colors are provided. These inking devices 105*a* to 105*d*, 106*a* to 106*d* each have an ink fountain roller rotating with a shaft thereof rotatably supported by right and left frames, and an ink fountain device has a triangular cross sectional shape formed by the circumferential surface of the ink fountain roller, dam plates at the ends of the ink fountain device, and ink blade sections. Ink stored in the ink fountain device flows out from a gap between the circumferential surface of the ink fountain roller and the front ends of the ink blade sections upon rotation of the ink fountain roller, and the ink adheres to the circumferential surface of the ink fountain roller. Near the ink fountain roller, an ink distribution roller parallel thereto is rotatably disposed. The ink, adhered to the circumferential surface of the ink fountain roller, is transferred to the ink distribution roller by an ink ductor roller which is supported by an arm and reciprocates between the ink fountain roller and the ink distribution roller upon swaying of the arm. Then, the ink is uniformly flattened in different directions while being transferred among many groups of ink rollers, whereafter the ink is supplied to a plate surface on the plate cylinder by ink form rollers.

In the so constituted inking devices 105*a* to 105*d*, 106*a* to 106*d*, the ink fountain device has conventionally been switchable between two positions, i.e., an ink fountain position during printing (fixed position), and an ink fountain position during cleaning, adjustment, or long-term machine shutdown (throw-off position). As a method of fixing the inking devices 105*a* to 105*d*, 106*a* to 106*d* at the fixed position, a bolt-nut fixing method manually conducted by an operator has been adopted.

With the conventional inking device, the ink fountain device can be switched only between two positions as stated above. Thus, in a four-color double-sided simultaneous offset printing press having the ink fountain devices arranged vertically in multiple stages, for example, when the unused ink fountain devices are switched to the throw-off position, a space in a vertical direction between the unused ink fountain devices and the ink fountain devices, in use, located below them becomes small. This has made it difficult to secure a vertical space for operating the ink fountain. In addition, the conventional ink fountain device is fixed by the bolt-nut fixing method relying on the operator's manual work. Hence, a change in a clamping force occurs during fixing, thereby changing the amount of gap between the ink fountain roller and the ink blade sections and vary the amount of ink being fed. A clamping force control method using a torque wrench is also carried out. However, this method has involved the inconvenience of requiring a tool.

SUMMARY OF THE INVENTION

The present invention has been conceived in consideration of the above-mentioned problems with the earlier technology. It is an object of the present invention to provide an inking device of a rotary press which makes it easy to secure a vertical space for operating an ink fountain, and which can fix an ink fountain device with a constant clamping force without using a tool.

The present invention, which attains the above object, is an inking device of a rotary press, which comprises an ink fountain roller supported rotatably, and an ink fountain device movable toward and away from the ink fountain roller, wherein the ink fountain device is switchable among a fixed position close to the ink fountain roller, a throw-off position separated from the ink fountain roller, and an intermediate position provided between the fixed position and the throw-off position, and switching means is provided for switching the ink fountain device at any of the three positions. Thus, the inking device can easily secure a vertical space for operating an ink fountain, and can fix the ink fountain device with a constant clamping force without using a tool.

The ink fountain device may have a first spring member for pressing the ink fountain device when the ink fountain device is located at the fixed position to prevent backlash of the ink fountain device by the first spring member.

The switching means may comprise an eccentric pin rotatably supported by at least one of the frames, a locking handle fixedly provided on the eccentric pin, and a hook pivotably fitted onto an eccentric shaft portion of the eccentric pin, and releasably supported on an engagement pin provided on the ink fountain device. The locking handle can be held at a first position, at which the ink fountain device is held at the fixed position, with the hook being engaged with the engagement pin, and a second position, at which the ink fountain device is held at the intermediate position, with the hook being engaged with the engagement pin. The locking handle can also move to a third position at which engagement between the hook and the engagement pin can be released.

Holding means for holding the locking handle at each of the first position, the second position, and the third position may be provided. The holding means may comprise grooves, an engagement member for engaging the groove, and a second spring member for urging the engagement member in a direction in which the engagement member engages the groove.

Release means may be provided for releasing the hook from the engagement pin when the locking handle is located at the third position, and the hook may be disengaged from the engagement pin by moving the ink fountain device upward. The release means may have a third spring member for urging the hook in a direction in which engagement of the hook with the engagement pin is released, when the locking handle is located at the third position, and for releasing an urging force on the hook when the locking handle is located at the first position or the second position.

The engagement pin may be engaged with the hook by upwardly moving the ink fountain device located at the throw-off position when the locking handle is located at the second position.

The hook may have, at a front end thereof, an inclined surface raised by the engagement pin. The hook raised by the engagement pin may engage the engagement pin by the own weight of the hook.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Preferred embodiments of an inking device of a rotary press according to the present invention will now be described in detail with reference to the accompanying drawings, which in no way limit the invention.

Figure 1:
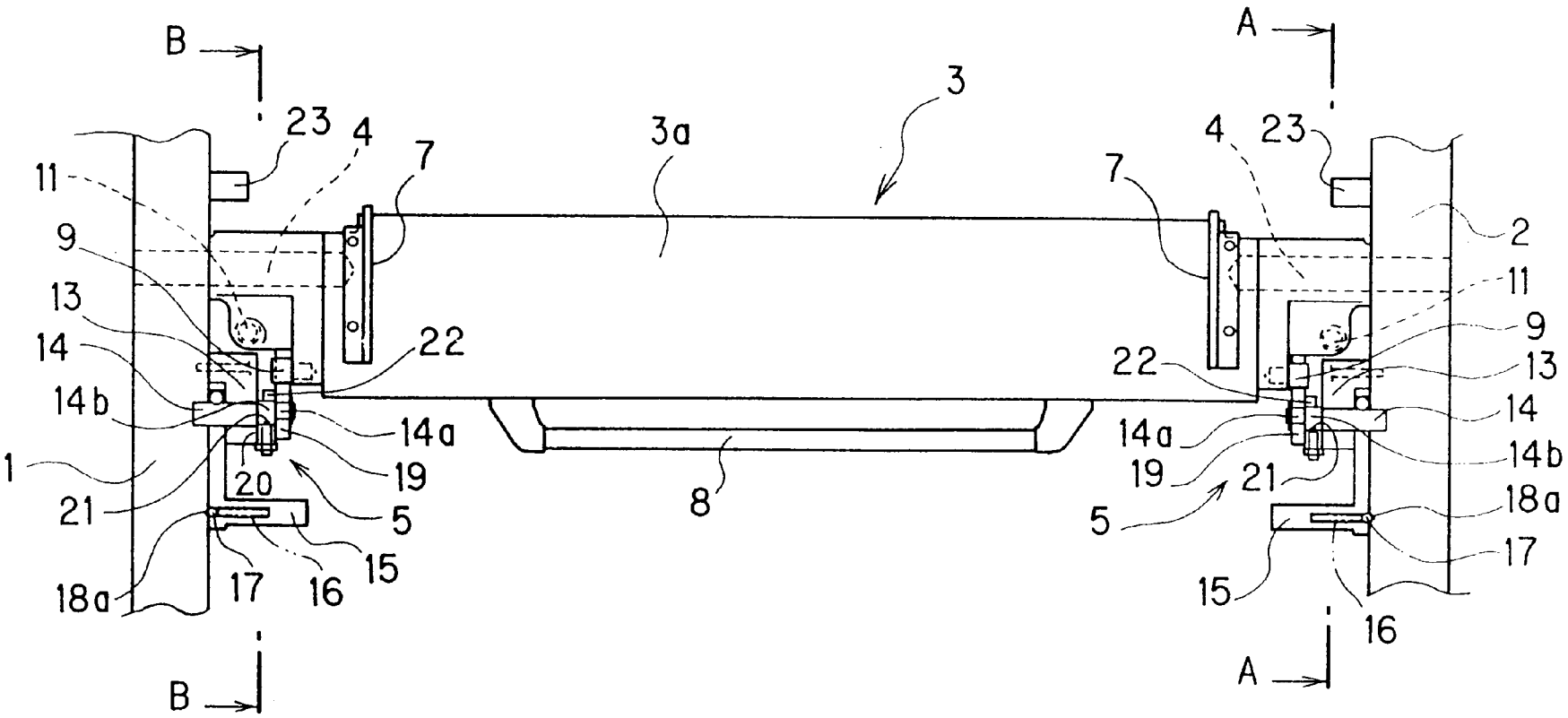
FIG. 1 is a plan view of an inking device of a rotary press according to an embodiment of the present invention.
Figure 2:
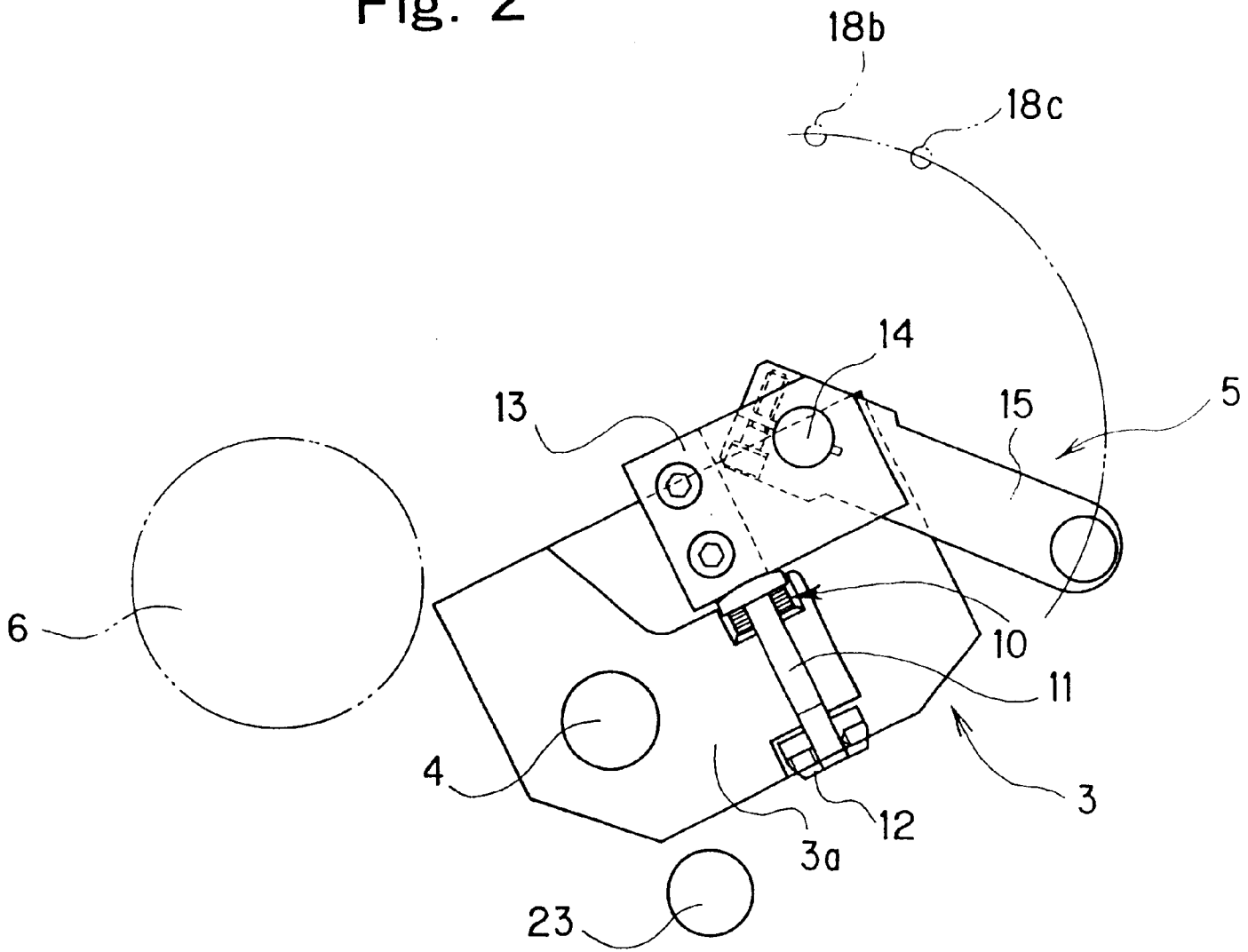
FIG. 2 is a sectional view taken along line A—A of FIG. 1.
Figure 3:
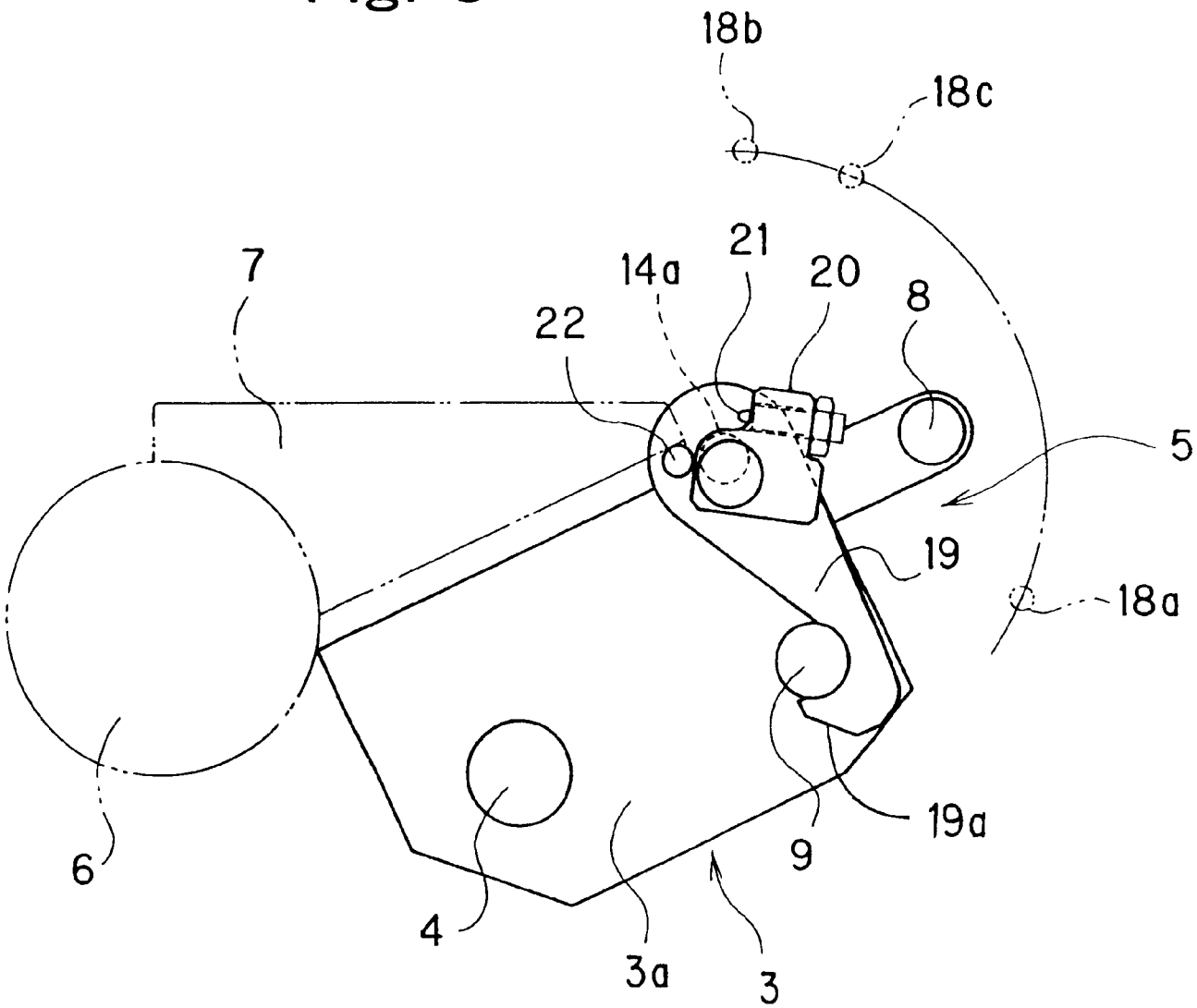
FIG. 3 is a sectional view taken along line B—B of FIG. 1.
Figure 4:
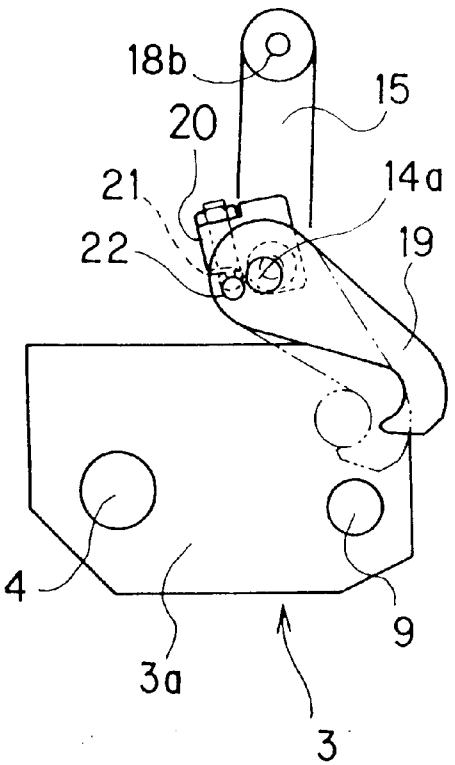
FIGS. 4(*a*) to 4(*c*) are explanatory drawings of a switching motion of an ink fountain device.
Figure 4:
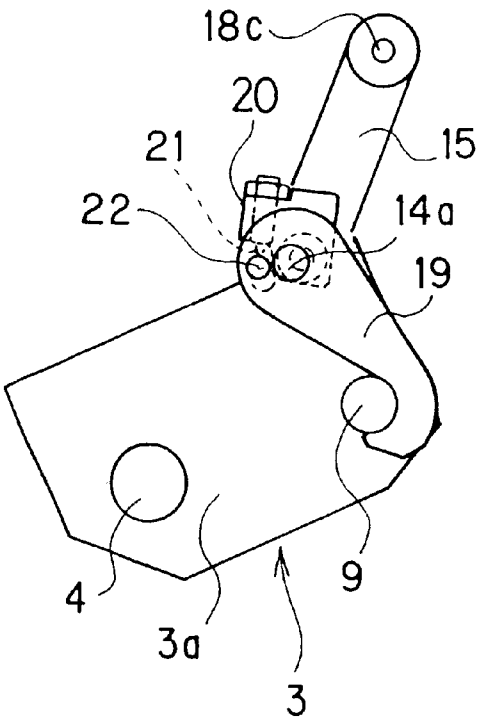
Figure 4:
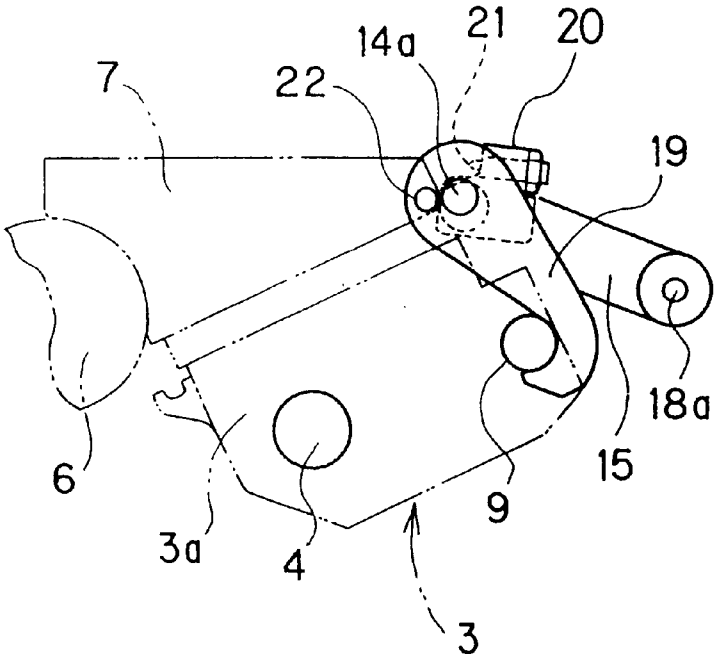
Figure 5:
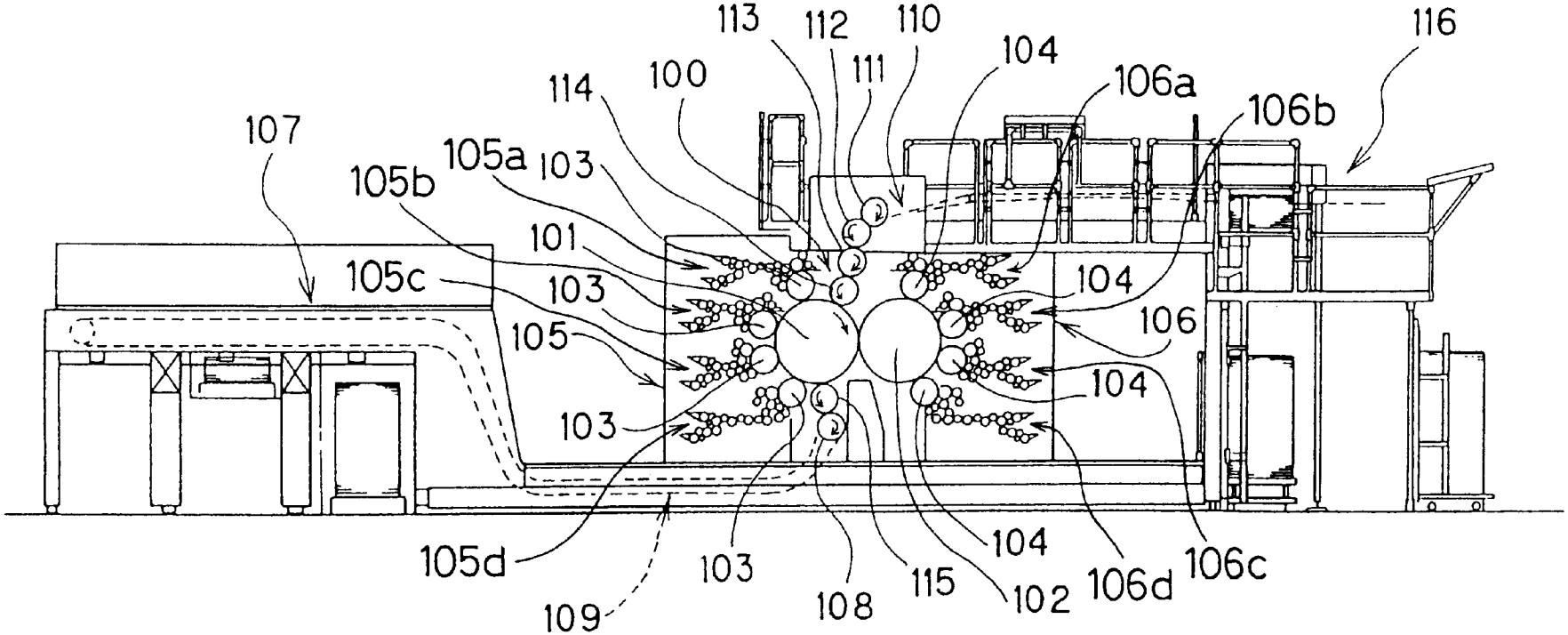
Fig. 5 PRIOR ART
FIG. 5 is a general side view of a conventional four-color double-sided simultaneous offset printing press.

FIG. 1 is a plan view of an inking device of a rotary press according to an embodiment of the present invention. FIG. 2 is a sectional view taken along line A—A of FIG. 1. FIG. 3 is a sectional view taken along line B—B of FIG. 1. FIGS. 4(*a*) to 4(*c*) are explanatory drawings of a switching motion of an ink fountain device.

As shown in FIGS. 1 to 3, an ink fountain device 3 is pivotably supported by pivot shafts 4 between left and right frames 1, 2 of a rotary press. The ink fountain device 3 can be moved by left and right switching means 5 as a pair (to be described later) toward and away from an ink fountain roller 6 which has a shaft similarly supported rotatably between the left and right frames 1, 2. The ink fountain device 3 has left and right dam plates 7, as a pair, fixedly provided on an upper surface portion of an ink fountain body 3*a*, and also has an ink fountain handle 8 fixedly provided on a front surface portion of the ink fountain body 3*a*. Engagement pins 9 are provided projectingly on left and right end surface portions of the ink fountain body 3*a*. Bolts 11 for preventing backlash, which are urged by coned disc springs 10, are assembled with stopper nuts 12 to left and right end portions of the ink fountain body 3*a*. During locking of the ink fountain device 3 at a fixed position to be described later, the bolts 11 for preventing backlash are pressed against the lower surfaces of brackets 13 mounted projectingly on the inner surfaces of the left and right frames 1, 2 to prevent backlash of shaft supports of the ink fountain device 3.

The switching means 5 comprises an eccentric pin 14 penetrating the bracket 13 and rotatably supported by the left or right frame 1 or 2, and a locking handle 15 fixedly provided at a base end portion of the eccentric pin 14 for revolvingly operating the eccentric pin 14. A steel ball 17, urged by a spring 16, is assembled to a front end portion of the locking handle 15. The steel ball 17 selectively engages any of three engagement grooves 18*a*, 18*b*, and 18*c* formed in the inner surface of the left or right frame 1 or 2, whereby the ink fountain device 3 is located at each of a fixed position (corresponding to the engagement groove 18*a*) close to the ink fountain roller 6 at the time of printing, a throw-off position (corresponding to the engagement groove 18*b*) during cleaning, adjustment, or long-term machine shutdown, and an intermediate position (corresponding to the engagement groove 18*c*) at which the ink fountain device 3 is temporarily fixed between the fixed position and the throw-off position. A hook 19 is pivotably fitted onto an eccentric shaft portion 14*a* at the front end of the eccentric pin 14. The hook 19 engages the engagement pin 9 when the ink fountain device 3 is located at the fixed position or the intermediate position. The hook 19 has at its front end portion an inclined surface 19*a* to be raised by the engagement pin 9. A plunger (release means) 21, urged by a spring, is provided at an intermediate shaft portion 14*b* of the eccentric pin 14 via a support block 20. At a predetermined revolving position of the eccentric pin 14, namely, at a position where the locking handle 15 engages the engagement groove 18*b*, the plunger 21 is pressed against a stopper pin (release means) 22 annexed to the side surface of the hook 19 to release the hook 19 from the engagement pin 9. Numeral 23 denotes a stopper at the throw-off position of the ink fountain device 3.

Next, a switching operation of the ink fountain device 3, constituted as described above, will be described with reference to FIGS. 4(*a*) to 4(*c*).

FIG. 4(*a*) shows switching to the fixed position of the ink fountain device 3 during printing when the ink fountain device 3 approaches the ink fountain roller 6. At the time of this switching, the steel ball 17 of the locking handle 15 is urged by the spring 16, and engaged with the engagement groove 18*a* of the left or right frame 1 or 2. In this state, the hook 19, supported by the eccentric shaft portion 14*a* of the eccentric pin 14, engages the engagement pin 9 of the ink fountain body 3*a*, so that this state is stably maintained.

Also, the head of the bolt 11 on the ink fountain body 3*a* is urged by the coned disc spring 10, and pressed against the lower surface of the bracket 13 at the side of the left or right frame 1 or 2. Thus, the ink fountain body 3*a* is always pivotally urged in a clockwise direction about the pivot shaft 4. Consequently, backlash at support shaft portions, such as the pivot shaft 4 and the eccentric pin 14 (eccentric shaft portion 14*a*), is prevented, and the ink fountain device 3 is fixed with high accuracy. That is, the ink fountain device 3 is fixed at the fixed position with a constant clamping force without using a special tool, so that highly accurate ink supply is achieved.

Next, FIG. 4(*b*) shows switching to the intermediate position of the ink fountain device 3 (temporary fixed position at which the ink fountain device 3 is not used temporarily). At the time of this switching, the steel ball 17 of the locking handle 15 is urged by the spring 16, and engaged with the engagement groove 18*c* of the left or right frame 1 or 2. In this state, the hook 19 is slightly displaced downward relative to the left or right frame 1 or 2 by the eccentric action of the eccentric shaft portion 14*a* in accordance with the counterclockwise revolution of the eccentric pin 14. Thus, the ink fountain body 3*a*, engaging the hook 19 via the engagement pin 9, slightly pivots in a clockwise direction about the pivot shaft 4. As a result, with an ink fountain key (not shown) being set on the ink fountain body 3*a*, the front ends of ink blade sections (not shown) can be kept away from the circumferential surface of the ink fountain roller 6. This makes prompt action possible for a next use. Moreover, the ink fountain body 3*a* is only slightly displaced downward from the fixed position to a position different from a throw-off position to be described later. Thus, sufficient space can be secured below this position. In other words, even if unused ink fountain devices 3 exist in a four-color double-sided simultaneous offset printing press with ink fountain devices 3 arranged vertically in multiple stages, an ample vertical space can be secured for operating the ink fountain in the ink fountain devices 3 in use and located below the unused ink fountain devices 3.

Next, FIG. 4(*c*) shows switching to the throw-off position during cleaning, adjusting, or long-term machine shutdown of the ink fountain device 3. At the time of this switching, the steel ball 17 of the locking handle 15 is urged by the spring 16, and engaged with the engagement groove 18*b* of the left or right frame 1 or 2. In this state, in accordance with the counterclockwise revolution of the eccentric pin 14, the front end of the plunger 21 is pressed against the stopper pin 22 annexed to the hook 19 to pivotally urge the hook 19 in a counterclockwise direction about the eccentric shaft portion 14*a*. Thus, the ink fountain handle 8 is operated to turn (lift) the ink fountain body 3*a* slightly in the counterclockwise direction about the pivot shaft 4, whereby the hook 19 automatically departs from the engagement pin 9 of the ink fountain body 3*a*. Then, the ink fountain body 3*a*, as such, is lowered until it contacts the stopper 22, whereby the ink fountain device 3 is located at the throw-off position.

According to the present embodiment, in the above-described manners, the ink fountain device 3 is switched, easily, promptly, and with high accuracy by a handle operation, among the fixed position at the time of printing, the throw-off position during cleaning, adjusting, or long-term machine shutdown, and the intermediate position at which the ink fountain device 3 is temporarily fixed between the fixed position and the throw-off position. Furthermore, an ample vertical space for operating the ink fountain can be secured by switching to the intermediate position.

After switching of the ink fountain device 3 to the throw-off position, the locking handle 15 is returned to the engagement groove 18*c* corresponding to the intermediate position of the ink fountain device 3. This is preferred, because a prompt action can be taken when switching the ink fountain device 3 to the fixed position for a next operation. That is, when the ink fountain handle 8 is brought upward, the engagement pin 9 ascends along the inclined surface at the front end of the hook 19. Then, the engagement pin 9 passes over the front end of the hook 19, whereupon the engagement pin 9 is engaged with the hook 19. Then, the locking handle 15 is turned to the position of the engagement groove 18*a*, whereby the ink fountain device 3 is located at the fixed position.

While the present invention has been described in the foregoing fashion, it is to be understood that the invention is not limited thereby, but may be varied in many other ways. For example, the release means for releasing the engagement between the hook and the engagement pin may be changed to other structures. The coned plate spring 10 may be provided on each of the frames 1, 2. The switching means 5 need not be provided on both frames (the same is true of the engagement pin 9). The locking handle 15 need not be held at the throw-off position (for example, the locking handle may be brought by the left hand to the throw-off position, and the ink fountain handle 8 may be operated by the right hand). Such variations are not to be regarded as a departure from the spirit and scope of the invention, and all such modifications as would be obvious to one skilled in the art are intended to be included within the scope of the appended claims.

What is claimed is:

1. An inking device of a rotary press, comprising:

a plurality of ink fountain devices arranged vertically in multiple stages, each ink fountain device of said plurality of ink fountain devices including a respective rotatably supported ink fountain roller;

each of said ink fountain devices being movable between three steady state positions including, a fixed position in which each said ink fountain device is located at a position close to the respective ink fountain roller, a throw-off position in which each said ink fountain device is separated from the respective ink fountain roller, and an intermediate position provided between said fixed position and said throw-off position; and wherein when an upper ink fountain device of an adjacent pair of ink fountain devices of said plurality of ink fountain devices is at said intermediate position, a space is provided above a lower ink fountain device of said pair of ink fountain devices for operating the lower ink fountain device; and respective switching means for switching and holding said ink fountain devices at said fixed, said throw-off, and said intermediate steady state positions.

2. The inking device of a rotary press as claimed in claim 1, wherein each said ink fountain device has a first spring member for pressing said ink fountain device when said ink fountain device is in said fixed position.

3. An inking device of a rotary press, comprising:

an ink fountain roller rotatably supported;

an ink fountain device movable between a fixed position in which said ink fountain device is located at a position close to said ink fountain roller, a throw-off position in which said ink fountain roller device is separated from said ink fountain roller, and an intermediate position provided between said fixed position and said throw-off position;

switching means for switching said ink fountain device between said fixed position, said throw-off position, and said intermediate position, said switching means including, an eccentric pin rotatably supported on at least one of frames, a locking handle fixedly provided on said eccentric pin, and a hook pivotably fitted onto an eccentric shaft portion of said eccentric pin, and releasably supported on an engagement pin provided on said ink fountain device, wherein said locking handle can be held at a first position at which said ink fountain device is held at said fixed position, with said hook being engaged with said engagement pin, and a second position at which said ink fountain device is held at said intermediate position, with said hook being engaged with said engagement pin, and wherein said locking handle can move to a third position at which engagement between said hook and said engagement pin can be released.

4. The inking device of a rotary press as claimed in claim 3, further comprising:

holding means for holding said locking handle at each of said first position, said second position, and said third position.

5. The inking device of a rotary press as claimed in claim 4, wherein said holding means includes, grooves, an engagement member for engaging said groove, and a second spring member for urging said engagement member in a direction in which said engagement member engages said groove.

6. The inking device of a rotary press as claimed in claim 4, further comprising:

release means for releasing said hook from said engagement pin when said locking handle is located at said third position, wherein said hook is disengaged from said engagement pin by moving said ink fountain device in an upward direction.

7. The inking device of a rotary press as claimed in claim 6, wherein said release means has a third spring member for urging said hook in a direction in which engagement of said hook with said engagement pin is released, when said locking handle is located at said third position, and for releasing an urging force on said hook when said locking handle is located at said first position or said second position.

8. The inking device of a rotary press as claimed in claim 3, wherein said engagement pin is engaged with said hook by upwardly moving said ink fountain device located at said throw-off position when said locking handle is located at said second position.

9. The inking device of a rotary press as claimed in claim 8, wherein said hook has at a front end thereof an inclined surface raised by said engagement pin.

10. The inking device of a rotary press as claimed in claim 9, wherein said hook raised by said engagement pin engages said engagement pin by a weight of said hook.

11. An inking device of a rotary press, comprising:

an ink fountain roller supported rotatably;

an ink fountain device movable among a fixed position in which said ink fountain device is located at a position close to said ink fountain roller, a throw-off position in which said ink fountain device is separated from said ink fountain roller, and an intermediate position provided between said fixed position and said throw-off position;

switching means for switching said ink fountain device among said fixed position, said throw-off position, and said intermediate position, said switching means including, an eccentric pin rotatably supported on at least one of frames, a locking handle fixedly provided on said eccentric pin, a hook pivotably fitted onto an eccentric shaft portion of said eccentric pin, and releasably supported on an engagement pin provided on said ink fountain device, wherein said locking handle can be held at a first position at which said ink fountain device is held at said fixed position, with said hook being engaged with said engagement pin, and a second position at which said ink fountain device is held at said intermediate position, with said hook being engaged with said engagement pin, and wherein said locking handle can move to a third position at which engagement between said hook and said engagement pin can be released; and, further comprising, holding means for holding said locking handle at each of said first position, said second position, and said third position; and wherein said holding means includes, grooves, an engagement member for engaging said grooves, and a second spring member for urging said engagement member in a direction in which said engagement member engages said grooves.

12. An inking device of a rotary press, comprising:

an ink fountain roller supported rotatably;

an ink fountain device movable among a fixed position in which said ink fountain device is located at a position close to said ink fountain roller, a throw-off position in which said ink fountain device is separated from said ink fountain roller, and an intermediate position provided between said fixed position and said throw-off position;

switching means for switching said ink fountain device among said fixed position, said throw-off position, and said intermediate position, said switching means including, an eccentric pin rotatably supported on at least one of frames, a locking handle fixedly provided on said eccentric pin, a hook pivotably fitted onto an eccentric shaft portion of said eccentric pin, and releasably supported on an engagement pin provided on said ink fountain device, wherein said locking handle can be held at a first position at which said ink fountain device is held at said fixed position, with said hook being engaged with said engagement pin, and a second position at which said ink fountain device is held at said intermediate position, with said hook being engaged with said engagement pin, said locking handle can move to a third position at which engagement between said hook and said engagement pin can be released; and, further comprising, holding means for holding said locking handle at each of said first position, said second position, and said third position;

release means for releasing said hook from said engagement pin when said locking handle is located at said third position, and, wherein said hook is disengaged from said engagement pin by moving said ink fountain device in an upward direction.

13. An inking device of a rotary press, comprising:

an ink fountain roller rotatably supported;

an ink fountain device movable between a fixed position in which said ink fountain device is located at a position close to said ink fountain roller, a throw-off position in which said ink fountain device is separated from said ink fountain roller, and an intermediate position provided between said fixed position and said throw-off position;

switching means for switching said ink fountain device between said fixed position, said throw-off position, and said intermediate position, said switching means including, an eccentric pin rotatably supported on at least one of frames;

a locking handle fixedly provided on said eccentric pin;

a hook pivotably fitted onto an eccentric shaft portion of said eccentric pin, and releasably supported on an engagement pin provided on said ink fountain device, wherein said locking handle can be held at a first position at which said ink fountain device is held at said fixed position, with said hook being engaged with said engagement pin, and at a second position at which said ink fountain device is held at said intermediate position, with said hook being engaged with said engagement pin, wherein said locking handle can move to a third position at which engagement between said hook and said engagement pin can be released; and wherein said engagement pin is engaged with said hook by upwardly moving said ink fountain device located at said throw-off position when said locking handle is located at said second position.

* * * * *